US008442391B2

(12) United States Patent
Ericson

(10) Patent No.: US 8,442,391 B2
(45) Date of Patent: May 14, 2013

(54) DEVICE FOR PROVIDING HEAT RADIATION OF A SURFACE

(75) Inventor: Birger Ericson, Alingsås (SE)

(73) Assignee: Speedheater System AB, Savedalen (SE)

( * ) Notice: Subject to any disclaimer, the term of this patent is extended or adjusted under 35 U.S.C. 154(b) by 1673 days.

(21) Appl. No.: 11/444,334

(22) Filed: Jun. 1, 2006

(65) Prior Publication Data

US 2007/0280654 A1 Dec. 6, 2007

(51) Int. Cl.
*B44D 3/16* (2006.01)

(52) U.S. Cl.
USPC ..... 392/410; 392/423

(58) Field of Classification Search ..... 392/410, 392/411, 422
See application file for complete search history.

(56) References Cited

U.S. PATENT DOCUMENTS 1,659,780 A * 2/1928 Meyer ..... 392/379
1,669,569 A * 5/1928 Meyer ..... 392/379
1,686,024 A * 10/1928 Meyer ..... 392/379
1,781,879 A * 11/1930 Norden ..... 392/379
2,694,135 A * 11/1954 Brockmole ..... 392/409
4,556,786 A * 12/1985 Frost et al. ..... 219/459.1
6,154,606 A * 11/2000 Shaw et al. ..... 392/360
6,304,721 B1 * 10/2001 Ericson ..... 392/410
6,654,550 B1 * 11/2003 Lemanski ..... 392/409

* cited by examiner

*Primary Examiner* — Thor Campbell
(74) *Attorney, Agent, or Firm* — Young & Thompson

(57) ABSTRACT

A device for providing heat radiation of a surface which is intended to be radiated for softening and removing of old paint, putty or furnish or drying of moisture. The heat radiation from the device is obtained by electric resistance wires forming a heat radiation element arranged in an open box. An arrangement for making the device more resistant to shocks is achieved by attaching the heat radiation element resiliently relatively to the casing. A reflector unit for such a paint removal device for reflecting of heat radiation includes a reflecting surface, at least one heat radiating element and resilient suspension attachments, the reflector unit including a plurality of attachment points for mounting of the resilient suspensions attachments thereto, the at least one heat radiating element being attached to at least two resilient suspension attachment s so as to face the reflecting surface of the reflector unit.

3 Claims, 6 Drawing Sheets

DEVICE FOR PROVIDING HEAT RADIATION OF A SURFACE

TECHNICAL FIELD

The present invention relates to a device for providing heat radiation of a surface which is intended to be radiated for softening and removing of old paint, putty or furnish or drying of moisture. The heat radiation from the device is obtained by means of electric resistance wires forming a heat radiation element arranged in an open box. In particular, the invention relates to an arrangement for making the device more resistant to shocks.

BACKGROUND ART

During renovation of wooden surfaces of old houses, it is normally required to remove several coats of successively painted unsightly cracked and flaking oil- and/or plastic-based paint. Various methods are available for executing this work, wherein the removal of the paint for example can be carried out by means of scraping or grinding, which either implies a great effort of costly manpower or diffusion of ecologically harmful dust and disturbing noise. Heating devices are also utilized in order to burn off paint or rather to soften the paint by means of heating, so that it would be easier to scrape the paint off the wood. A device for such treatment of a surface is disclosed in U.S. Pat. No. 6,304,721 by means of which the paint is softened by radiation from a source of infra-red radiation. Thereafter, the paint is immediately removed by means of mechanical treatment of the wooden surface.

The device described in U.S. Pat. No. 6,304,721 has a relatively low weight and is intended to be used as a handheld tool which is easy to handle and its low weight also permits easy mounting on a light and variable suspension device. Although this device operates satisfactorily, it is sensitive to shocks or dropping of the device. In particular, the infrared heat radiation elements, which normally comprise a fragile casing, e.g. glass, surrounding the electric resistance wire, may be damaged or broken if the heating device is hit or in another way mishandled.

DISCLOSURE OF INVENTION

As a result of this, there is a desire to provide a new paint removal device which overcomes the above mentioned drawbacks of prior art. Therefore, according to the invention, a device for providing heat radiation to a surface for softening and removing old paint, varnish, putty or the like or for removal of moisture from the surface is provided. The heat radiation is obtained by means of electric resistance wires forming part of a heat radiation element. The heat radiation element is arranged in a casing which opens towards the surface intended to be treated. In order to make the device more resistant to shocks, the heat radiation element is resiliently attached relatively to the casing.

A device for providing heat radiation to a surface may for example be the device disclosed in U.S. Pat. No. 6,304,721, which is hereby incorporated by reference. The invention may of course be used for other similar devices and it is not essential that all the constructional details are the same as described therein. The casing, which is open at least towards the surface to be treated, may be produced in any suitable way. However, it is considered to be advantageous to include a reflector plate which either may form a part of the casing or be a separate member. The reflector may be just a planar plate, it may be a backing plate provided with sidewalls which at least partly enclosing the heat radiation elements, a half-cylindrical element or a bowl shaped, elliptic structure. Furthermore, the paint removal device advantageously comprises sidewalls which may be used as spacing elements to locate the paint removal device in an appropriate position with respect to the surface to be treated and thereby controlling the distance between the heat radiation elements and said surface. The side walls may also work as reflecting elements and may thereby improving the heat transfer efficiency. In case of a rectangular device, at least the long sides of the casing are provided with side walls in a preferred embodiment. In addition, also the short sides may be provided with side walls. However, separate side walls may not be desired in case the reflector itself comprises sidewalls or having a structure which at least partly enclosing the heat radiation elements. In this instance, separate distance elements may be provided, e.g. either rigidly mounted legs or pivotal or extendable legs which may provide a desired distance between the heating elements and the surface when the paint removal device is positioned in a working mode and being retracted in a transport or storage mode. Hence, the specific design of the paint removal device and the casing comprising the heat radiation element is not of crucial importance for the invention to work even though there are certain features which may contribute to make the functionality of the device in general to be improved. In U.S. Pat. No. 6,304,721 there are further advantageous solutions of constructional details including the assembly of the casing and the paint removal device in general, the inclusion of an exhaust treating arrangement and other elements such as reflectors and distance elements which may be used in the making of a paint removal device having a suspension of the heat radiation elements according to the invention.

The resilient suspension arrangement may comprise a resilient suspension of the attachment of the heat radiating devices to a part of the casing of the paint removal device, i.e. the heat radiation element is resiliently attached at its attachment points directly to the casing. The heat radiating device may also be mounted on a plate or the like which in turn is resiliently mounted to the casing of the paint removal device. There might of course also be a combination of these arrangements so that the heat radiating device is resiliently suspended at its attachment points to a part, e.g. a mounting plate, of the paint removal device whereby said part also in turn is resiliently mounted to the casing of the paint removal device. It is also possible that the heat radiation element is rigidly attached to a mounting plate and the mounting plate in turn is resiliently attached to the casing.

In a preferred embodiment, the mounting plate forms a partition wall which is disposed within the casing and the partition wall has a first side facing the opening of the casing which opens towards the surface intended to be treated and a second side facing a space formed between said partition wall and a backing plate of said casing. The mounting plate may also be a separate part from the partition wall.

In still another preferred embodiment of the heat radiation device, it is provided with a reflector which reflects the heat radiation towards the surface to be treated. The reflector may be a separate element or may be formed partly or completely by the partition wall or the mounting plate.

The resilient attachments, or suspensions, of the heat radiation element may be achieved in many different ways. One way is to use helical springs (coil springs) for the attachment, either directly or indirectly, between the heat radiation element and the casing. For instance, the heat radiation element may be attached to the casing or a mounting plate by means of helical springs. The heat radiation elements are preferably attached near each of its ends by means of the resilient springs. The springs will allow compression and tension in a first direction. Furthermore, the springs are preferably rotatably or pivotally attached to the mounting plate or the casing so as to allow movement of its attachment points to the heat radiation element in a 3-dimensional space. The spring itself may also have a certain bend ability which can contribute to make the attachment more flexible.

It is described that there should be preferably one spring at each end of the heat radiation element. However, it would also be possible to use more springs located at desired positions along the heat radiation element. Another alternative could be to use a single spring near the middle of the heat radiation element. In this case, the heat radiation element is preferably provided with dampeners, e.g. an elastic, shock absorbing material, which absorbs shock energy at each side of the attachment point of the heat radiation element and prevents it from hitting the casing hard in case of a sudden impact on the paint removal device.

The springs may advantageously be conical, frustoconical or cylindrical helical springs or but other kind of springs may also be used. It is also possible to use a resilient material for the suspension which is adapted to absorb shocks in order to prevent damage of the heat radiation elements in case of an accident like dropping the paint removal device or hitting it. Hence, there are many ways for the skilled person in the art to construct a resilient suspension within the scope of the invention As already disclosed, a resilient suspension may also be arranged between a mounting plate and the casing.

It is also possible to allow resilient attachment between the casing and the mounting plate together with a resilient attachment between the mounting plate and the heat radiation device. In this case it would be possible to let the resiliency of the different suspensions cooperate and work in different directions so as they together will allow a 3-dimensional movement and being able to absorb shocks in any direction, e.g. the mounting plate may be attached to the casing by a mounting rim which is made of a resilient material and being resilient in a first direction while the attachment of the heat radiation element is attached rotatably to the mounting plate or having a suspension allowing translational movement in the other 2 directions perpendicular to the resiliency direction of the suspension between the plate and the casing.

Hence, in a preferred embodiment of the invention, the resilient attachment is arranged so as to allow resilient movement of the suspended heat radiation element with respect to the casing in a 3-dimensional way so as to absorb shocks in any desired direction.

The invention also relates to a reflector unit for a paint removal device for reflecting of heat radiation. The reflector unit comprises a reflecting surface, at least one heat radiating element attached to the reflector at a plurality of attachment points in the reflector and resilient suspension attachments for attachment of at least one heat radiating element to the attachment points in the reflector.

BRIEF DESCRIPTION OF DRAWINGS

The invention will be further described in the following with reference to the annexed drawings, in which.

EMBODIMENT(S) OF THE INVENTION

Figure 1:
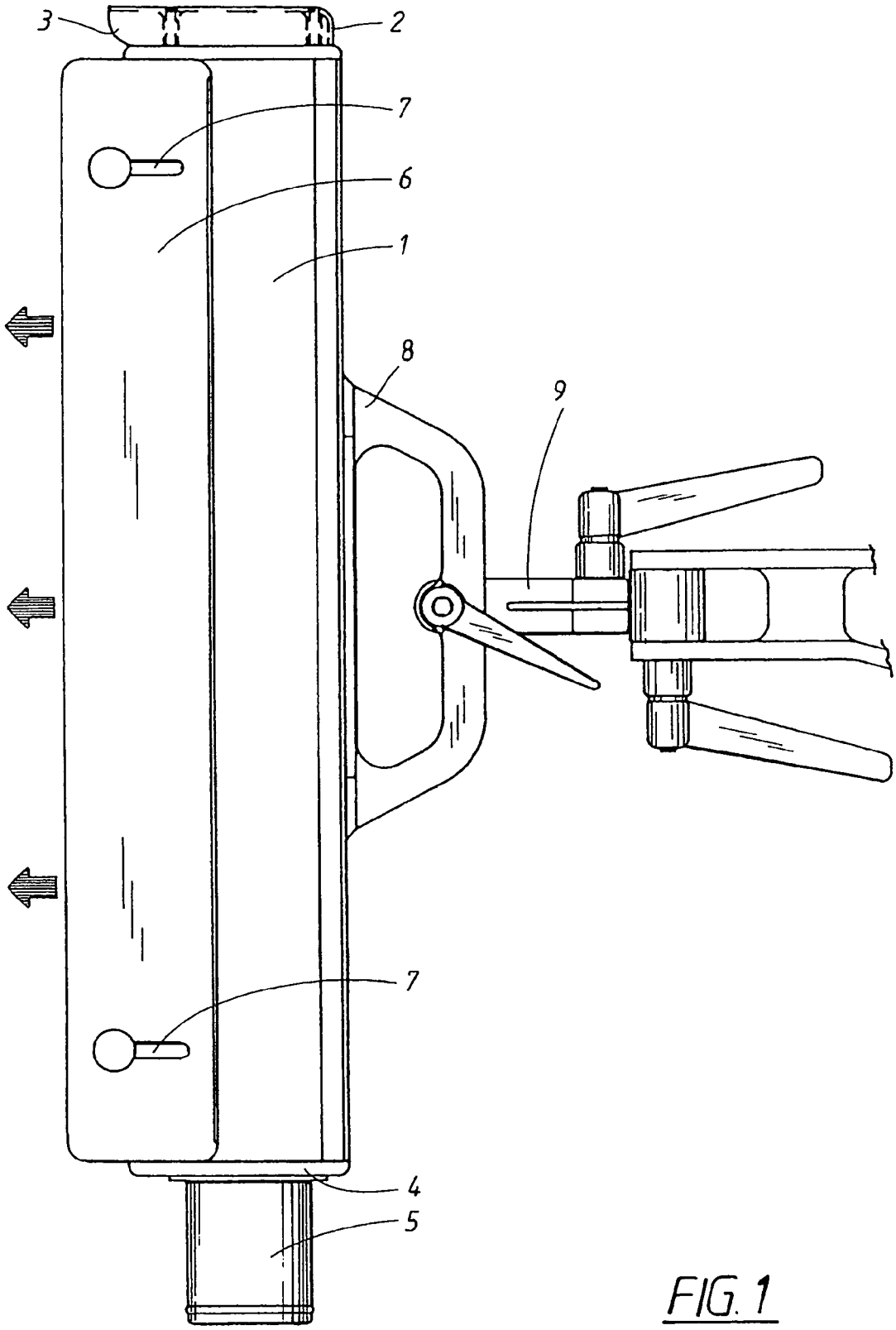
FIG. 1 is a side view of a paint removal device comprising heat radiation elements.

FIG. 1 shows a side view of a paint removal device suitable for the present invention having a casing 1 which is formed by extrusion pressing and preferably made of aluminium. At its upper end portion, the device is provided with a lid 2 having a suction opening 3 for smoke, and a lower lid 4 which is provided with a tube dowel 5 for connection to a suction device. When the device is utilized, heat radiates from the device to the left in the drawing, as is indicated by the arrows. On each side of the casing 1 towards the surface which is to be treated, two distance holders 6 are provided, one of which, the left in the direction of the radiation, is shown in the drawing. These distance holders 6 are made in the form of wall pieces or plates which are in close contact with the surface being treated and, therefore, they enclose the working surface at the sides. The distance holders 6 are provided with slots 7, so that they can be screwed on by means of these and be moved forwards or backwards. As is apparent, the device according to this drawing is provided with a handle unit 8 which has been inserted into tracks on the backside of the main component. The handle unit 8 is fixed to a supporting arm 9.

Figure 2:
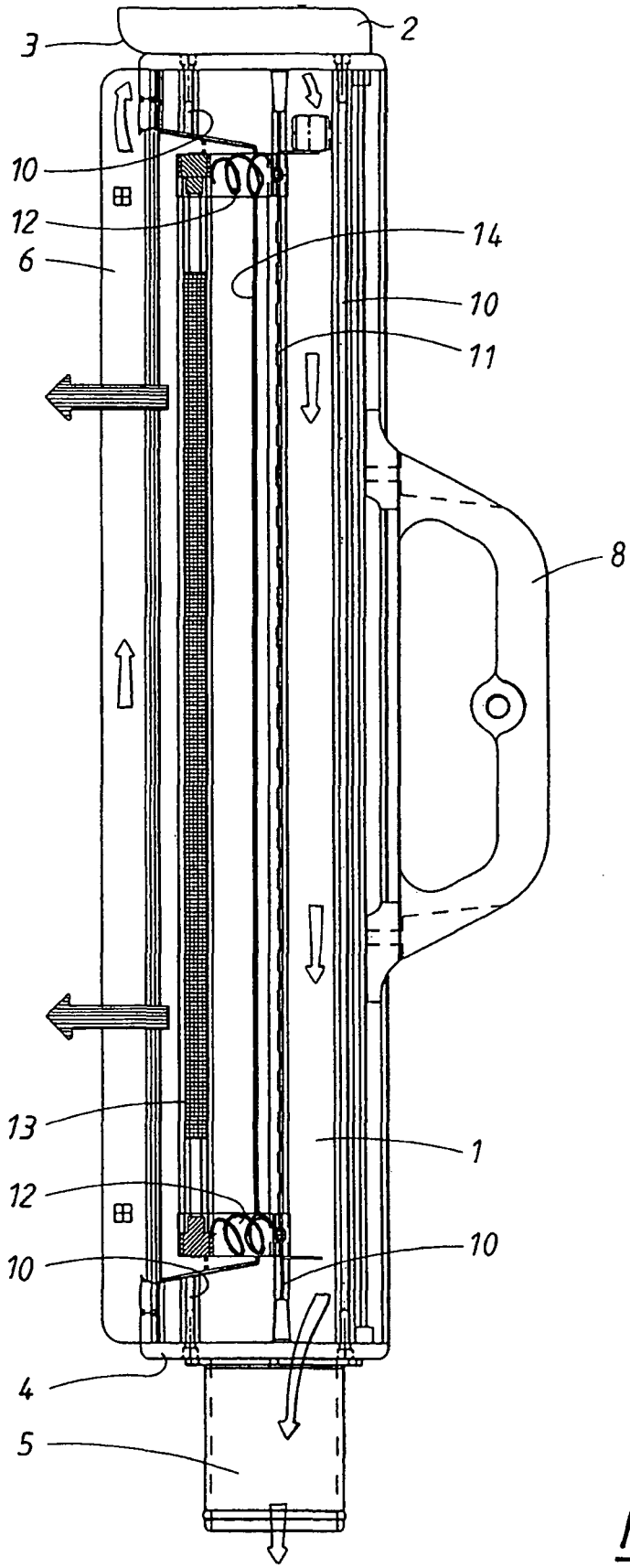
FIG. 2 is a vertical section of the device according to FIG. 1.

FIG. 2 shows a longitudinal section through the device having mounted lids 2, 4 and a handle 8. Longitudinal tracks 10 are provided on several locations on the inside and the outside of the casing 1. These tracks are constructed in connection with the extrusion pressing and constitute insertion and mounting brackets for various components.

In two of these tracks, one on each side of the casing 1, a partition wall 11 has been inserted. This partition wall 11 supports resilient holders 12 for the heat radiation elements 13. For the sake of clarity, the rest of the electric wires and their suspension have been excluded. The electric resistance wires can, however, be replaced by other electric heating devices, such as microwave devices.

Behind the heat radiation elements 13 but in front of the partition wall 11, a blank reflector 14 is provided. The reflector 14 is also inserted into a track on the inside of the casing 1.

The lid 2 in the right side of the drawing is intended to form the upper side of the device and fumes are sucked in through the opening 3 in this lid and flow downwards behind the partition wall 11 and out through the lid 4 having a mounted exhaust tube 5. Thus, this exhaust tube 5 is connected to some kind of fan which blows the fumes into some kind of purification plant. In the drawing, the course of the fumes is shown with unfilled arrows. The direction of the heat radiation from the device is shown with filled arrows.

Figure 3:
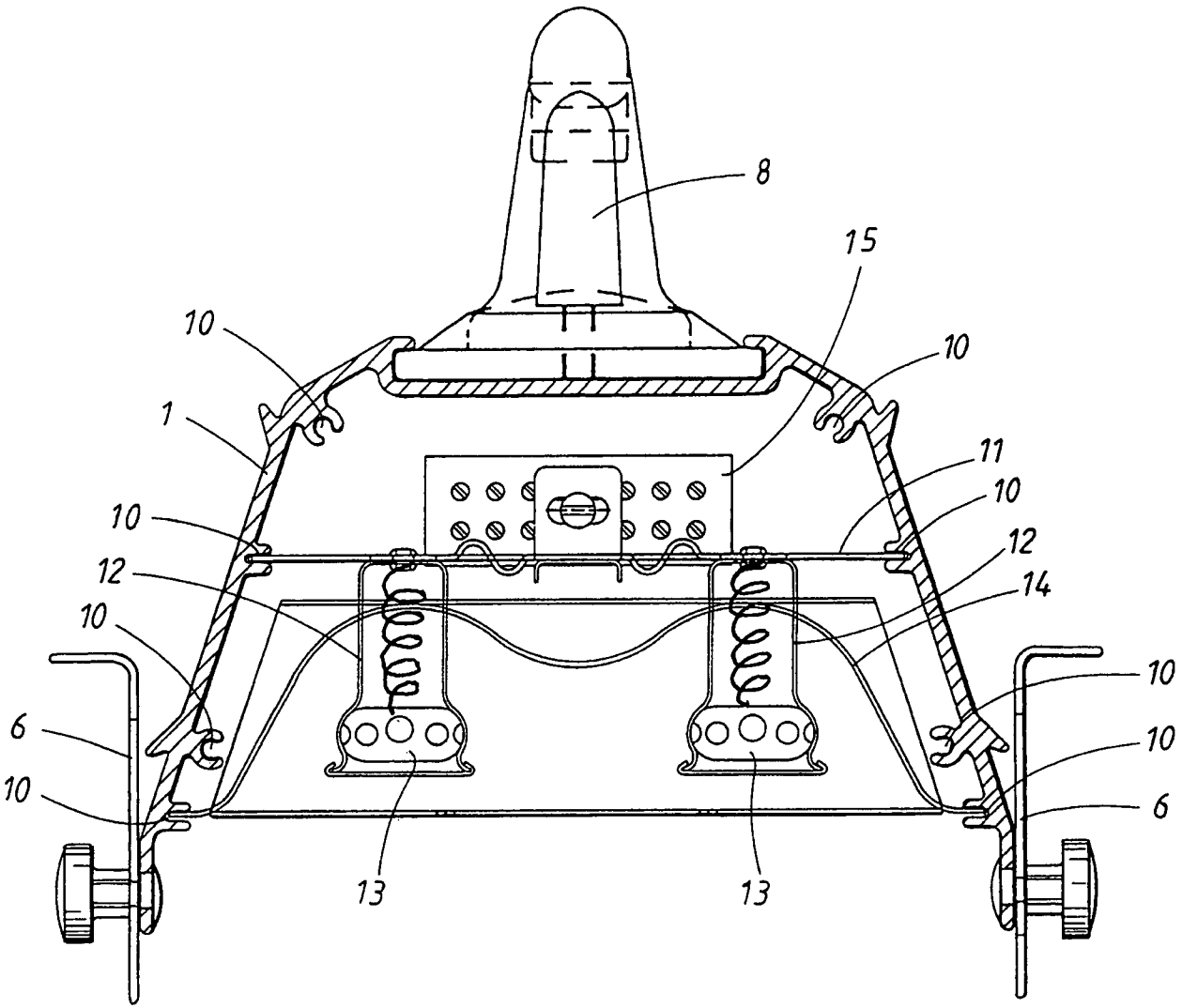
FIG. 3 is horizontal section of the device according to FIG. 1

FIG. 3 shows a horizontal section through the device according to the invention, from which drawing the location of the partition wall 11 and the reflector 14 is apparent. Due to the fact that two heat radiation elements 13 are provided, the reflector 14 has obtained a wave-form which guarantees a concentrated radiation of the surface.

As is apparent from the drawing, a plate 15 for electric devices is provided on the partition wall 11 and on the backside of this.

As is apparent, the handle unit 8 is inserted downwards in tracks on the outside of the casing 1, and two distance holders 6 are fastened with screws on each side of the opening of the main component 1 towards the side surface being treated.

Figure 4A:
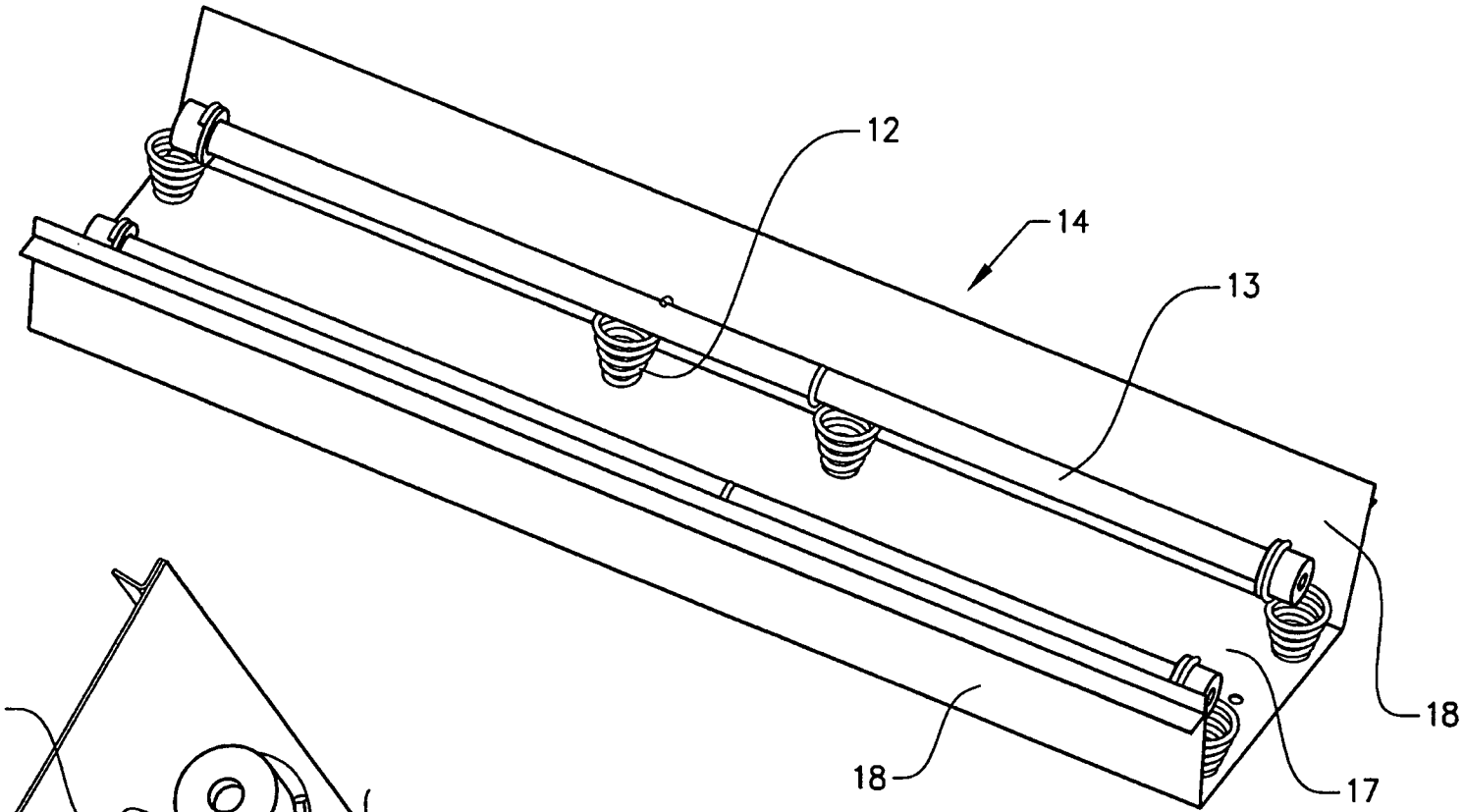
FIG. 4 shows a reflector unit provided with resilient suspensions of the heat radiation elements.
Figure 4B:
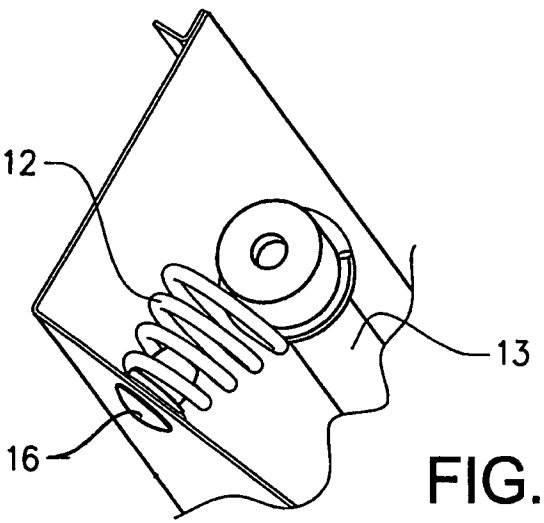

FIG. 4*a* is an isometric view of a reflector 14 to which two heat radiation elements 13 are attached. Each of the heat radiation elements 13 are attached to the reflector 14 by means of four resilient holders 12. The resilient holders 12 are in this case in the form of frustoconical helical springs. As can be better seen in FIG. 4*b*, the springs 12 are attached to the reflector 14 by screws 16. There might of course also be other way of attaching the springs 12, e.g. by welding or by shaping the end of the spring 12 which is attached to the reflector 12 so as to fit into a hole made in the reflector 14.

As can be seen in FIG. 4*a*, the reflector 14 comprises a backing plate 17 and two side plates 18 forming an elongated, U-shaped reflector 14 so that the reflector 14 partly encloses the heat radiation elements 13.

Figure 5:
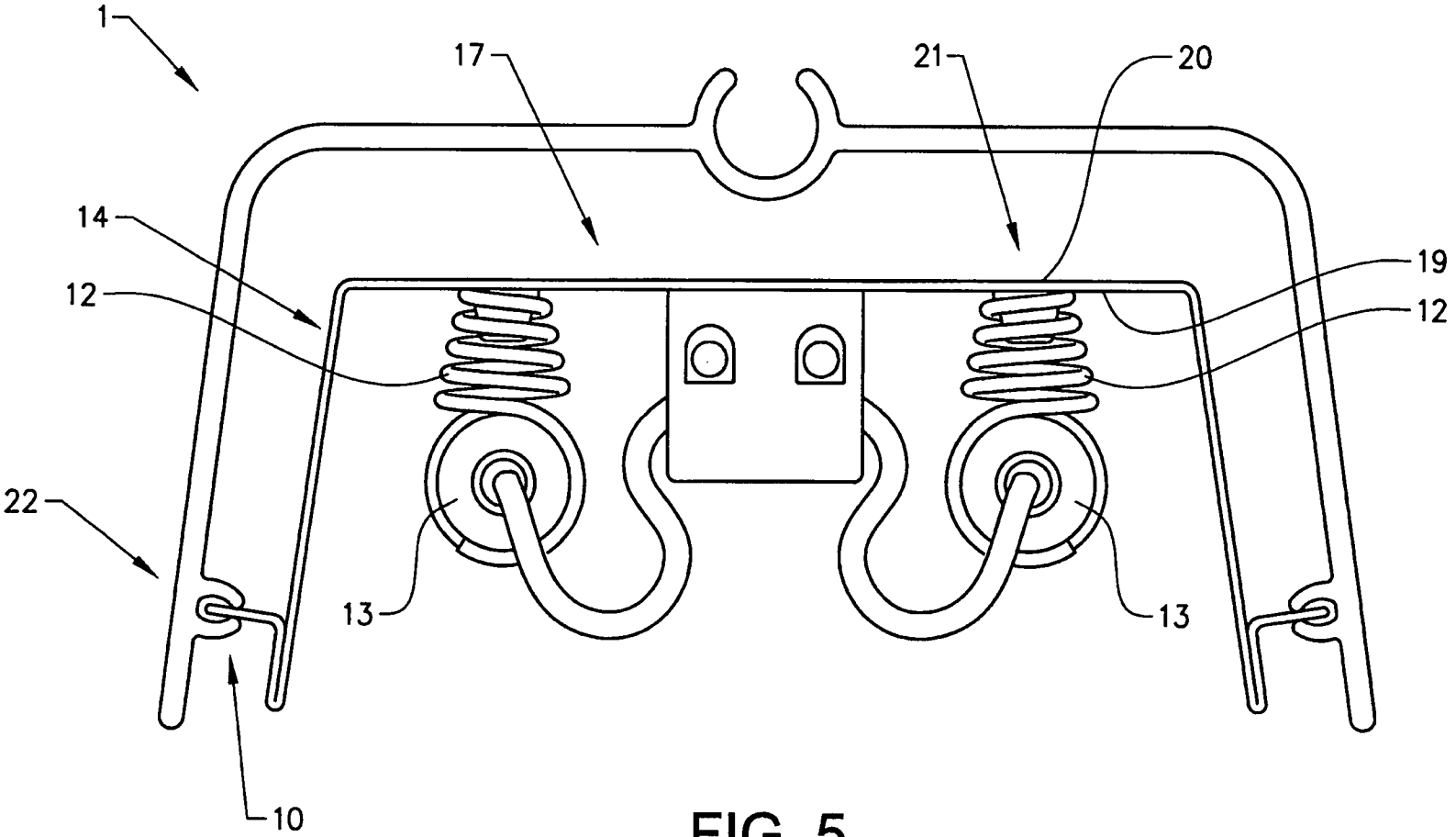
FIG. 5 is view of the reflector element in FIG. 4 mounted in a casing to form a paint removal device

FIG. 5 shows a side view of the reflector 14 in FIG. 4 as seen from its short side when mounted in a casing 1 with its side lid dismounted. The front side 19 of the backing plate 17 faces the heat radiation elements 13 and the backside 20 of the backing plate 17 faces the casing 1. In use, the paint removal device will be positioned so that the casing 1 and the reflector 14 are open towards the surface intended for treatment, i.e. the front side 19 of the backing plate 17 is facing the surface to be treated. In this embodiment, there is no separate partition wall 11 but the reflector 14 also forms an integrated partition wall 11. Furthermore, the reflector 14 also functions as a mounting plate 21 for the heat radiation elements 13. The heat radiation elements 13 are resiliently attached to the reflector 14 by springs 12. The reflector 14 is attached to the casing 1 by means of longitudinal racks 10 wherein flanges of the reflector 14 are fitted to form a rigid connection 22. In this case, it would be possible to add some extra resiliency by positioning a resilient material between the racks 10 and the flanges of the reflector 14 so as to achieve a resilient attachment between the casing 1 and the reflector 14.

FIG. 6 is a schematic view of different principal solutions for making the resilient suspension arrangement of the paint removal device.

Figure 6B:
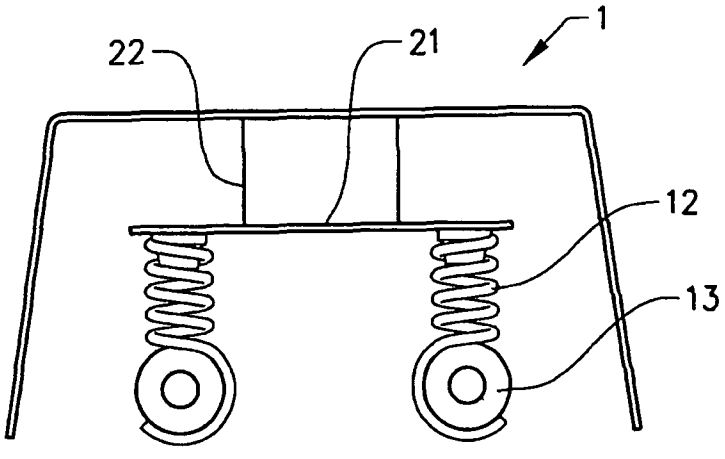
FIG. 6 is a schematic drawing showing different principles of how to attach heat radiation element resilient with respect to a casing
Figure 6D:
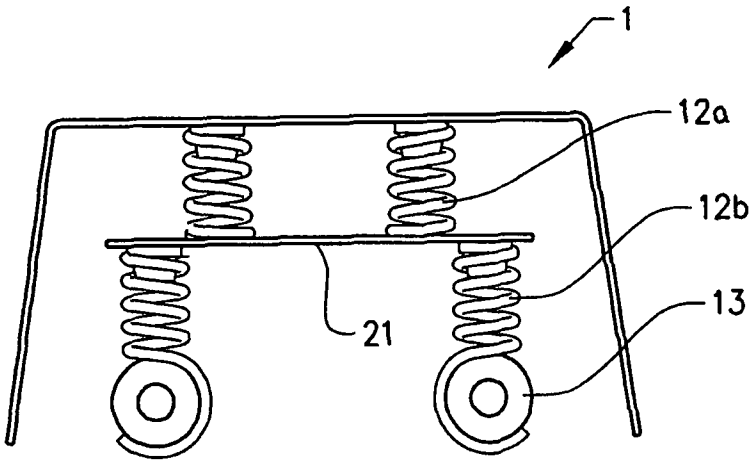
Figure 6A:
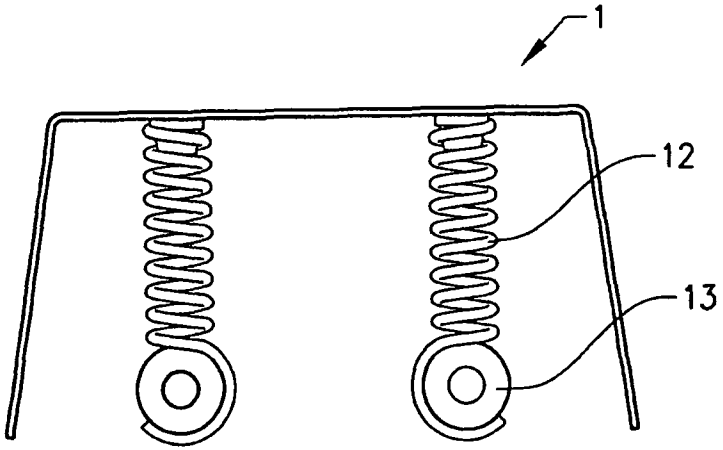

In FIG. 6*a*, the resilient holders 12 attaching the heat radiation elements 13 are attached directly to the casing 1.

In FIG. 6*b*, the heat radiation elements 13 are attached to a mounting plate 21 by resilient holders 12. The mounting plate 21 in turn is attached to the casing 1 by rigid holders 22. Hence, the principle of the resilient suspension arrangement described in FIG. 6*b* corresponds to the principle described in FIGS. 4 and 5 in which the heat radiation elements are resiliently attached to a combined reflector and mounting plate which is rigidly connected to a casing.

Figure 6C:
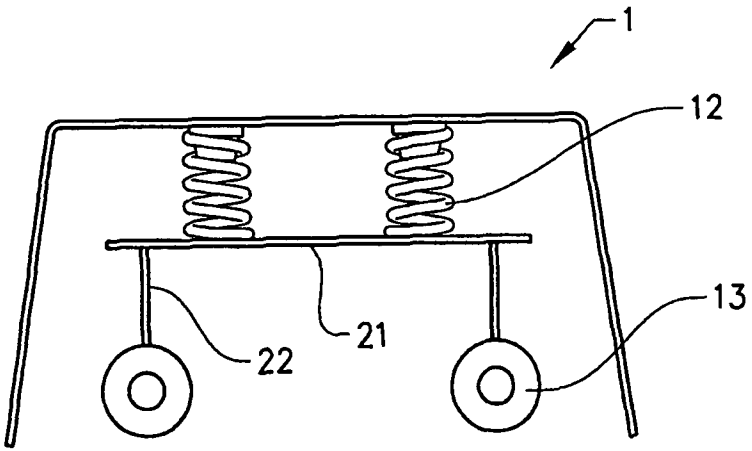

In FIG. 6*c*, the heat radiation elements 13 are attached to a mounting plate 21 by rigid holders 22. The mounting plate 21 in turn is attached to the casing 1 by resilient holders 12.

In FIG. 6*d*, the heat radiation elements 13 are attached to a mounting plate 21 by resilient holders 12*b*. The mounting plate 21 in turn is attached to the casing 1 by resilient holders 12*a*. In this case it would be possible to allow one of the attachments, 12*a* or 12*b*, to be rigid in certain directions if the other attachment compensates with resiliency in that direction if a resiliency in all directions is desired.

It shall be noted that the mounting plate 21 in these examples may be a separate unit or form part of a partition wall, a reflector or both of them. In FIGS. 1-3, the paint removal device described is provided with an arrangement for suction and handling of exhaust gases. It is obvious that the suspension arrangement would work as well in a device without such an arrangement.

The invention is not limited to the embodiment which is described above, but may be varied within the scope of the appended claims.

The invention claimed is:

1. A device for providing heat radiation to a surface for softening and removing old paint, varnish, putty or the like or for removal of moisture from the surface, said device comprising:

electric resistance wires forming part of a heat radiation element which is arranged in a casing having an opening which opens towards the surface intended for treatment wherein the heat radiation element is resiliently attached relative to the casing by at least one spring.

2. The device according to claim 1, wherein the at least one spring is a frustoconical helical spring.

3. The device according to claim 1, wherein there are four springs.

* * * * *